US010815977B2

(12) United States Patent
Kanstad

(10) Patent No.: US 10,815,977 B2
(45) Date of Patent: Oct. 27, 2020

(54) SYSTEMS AND METHODS FOR HYDRATE MANAGEMENT

(71) Applicant: ONESUBSEA IP UK LIMITED, London (GB)

(72) Inventor: Stig Kare Kanstad, Fana (NO)

(73) Assignee: ONESUBSEA IP UK LIMITED, London (GB)

( * ) Notice: Subject to any disclaimer, the term of this patent is extended or adjusted under 35 U.S.C. 154(b) by 563 days.

(21) Appl. No.: 15/160,887

(22) Filed: May 20, 2016

(65) Prior Publication Data

US 2017/0335833 A1 Nov. 23, 2017

(51) Int. Cl.

| | |
|---|---|
| ***F04B 41/00*** | (2006.01) |
| ***F04B 23/00*** | (2006.01) |
| ***F04B 11/00*** | (2006.01) |
| ***F04B 9/107*** | (2006.01) |
| ***E21B 43/12*** | (2006.01) |
| ***E21B 37/06*** | (2006.01) |
| ***E21B 41/00*** | (2006.01) |
| ***F04B 7/02*** | (2006.01) |

(Continued)

(52) U.S. Cl.

CPC ..... *F04B 7/02* (2013.01); *E21B 37/06* (2013.01); *E21B 41/0007* (2013.01); *E21B 43/12* (2013.01); *F04B 9/107* (2013.01); *F04B 11/0016* (2013.01); *F04B 11/0033* (2013.01); *F04B 15/00* (2013.01); *F04B 23/00* (2013.01); *F04B 37/20* (2013.01); *F04B 39/0055* (2013.01); *F04B 41/00* (2013.01)

(58) Field of Classification Search

CPC ..... F04B 7/02; F04B 41/00; F04B 39/0055; F04B 11/0008; F04B 11/0025; F04B 49/22; F04B 37/20; F04B 15/00; F04B 11/0033; F04B 11/0016; F04B 23/00; F04B 13/00; F04B 9/107; E21B 43/12; E21B 37/06; E21B 47/0007; E21B 43/126

See application file for complete search history.

(56) References Cited

U.S. PATENT DOCUMENTS

| | | | |
|---|---|---|---|
| 7,721,807 | B2 | 5/2010 | Stoisits |
| 8,517,111 | B2 | 8/2013 | Mix |

(Continued)

OTHER PUBLICATIONS

U.S. Non-Final Office Action dated Jul. 23, 2018, for U.S. Appl. No. 15/639,059.

*Primary Examiner* — Essama Omgba
*Assistant Examiner* — Christopher J Brunjes
(74) *Attorney, Agent, or Firm* — Helene Raybaud

(57) ABSTRACT

A fluid system includes a pumping flowline, wherein the pumping flowline is in selectable fluid communication with a production flowline, a cylinder including a first port and a second port, a piston slidably disposed in the cylinder, the piston sealing against an inner surface of the cylinder to form a first chamber and a second chamber, wherein the first chamber is in fluid communication with the first port and the second chamber is in fluid communication with the second port, and a first flowline in fluid communication with the first port of the cylinder and the pumping flowline, the first flowline including a first flowline valve, wherein, in response to opening the first flowline valve, the piston is displaced through the cylinder in a first direction to expand a volume of the first chamber of the cylinder.

14 Claims, 8 Drawing Sheets

(51) Int. Cl.

| | |
|---|---|
| ***F04B 39/00*** | (2006.01) |
| ***F04B 15/00*** | (2006.01) |
| ***F04B 37/20*** | (2006.01) |

(56) References Cited

U.S. PATENT DOCUMENTS

| | | | | |
|---|---|---|---|---|
| 2009/0032264 | A1 | 2/2009 | Shepler | |
| 2012/0031621 | A1* | 2/2012 | Fowler | F17D 1/17 166/338 |
| 2012/0103621 | A1* | 5/2012 | Kanstad | F28D 1/022 166/344 |
| 2015/0184490 | A1* | 7/2015 | Kanstad | F28G 9/00 166/335 |
| 2015/0315878 | A1* | 11/2015 | Smedstad | E21B 41/0007 166/351 |

* cited by examiner

SYSTEMS AND METHODS FOR HYDRATE MANAGEMENT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Natural-gas hydrates comprise crystalline solids that form when water and natural gas combine in high pressure and low temperature environments. The formation of hydrates may occur in oil and natural gas wells, pipelines, pumping systems, production systems, and other industrial applications. In some instances, hydrate formations result in the precipitation of ice-like hydrate plugs that reduce or block flow in fluid lines, including production lines. Once formed, hydrate plugs may be removed through altering the environmental conditions within the plugged equipment, such as by reducing fluid pressure, adding or increasing the concentration of hydrate inhibitors, and/or increasing the fluid temperature, each of which adds to the cost and complexity of the fluid system. Moreover, conventional hydrate remediation techniques sometimes include depressurizing entire flow lines instead of affected sections thereof in order to prevent accelerating loosened hydrate plugs which may damage components of the system. Given the issues presented by conventional hydrate remediation techniques, in some applications designers of fluid systems susceptible to hydrate formation attempt to prevent the formation of hydrates through onerous and expensive thermal analysis and testing of the fluid system prior to operation, which increases the cost of developing the fluid system and introduces additional design constraints, such as restrictions on pipe routing and the inclusion of expensive heat transfer mechanisms within the system.

SUMMARY

An embodiment of a fluid system comprises a pumping flowline, wherein the pumping flowline is in selectable fluid communication with a production flowline, a cylinder comprising a first port and a second port, a piston slidably disposed in the cylinder, the piston sealing against an inner surface of the cylinder to form a first chamber and a second chamber, wherein the first chamber is in fluid communication with the first port and the second chamber is in fluid communication with the second port, and a first flowline in fluid communication with the first port of the cylinder and the pumping flowline, the first flowline comprising a first flowline valve, wherein, in response to opening the first flowline valve, the piston is displaced through the cylinder in a first direction to expand a volume of the first chamber of the cylinder. In some embodiments, the pumping flowline comprises a compressor or a pump. In some embodiments, the fluid system further comprises a bypass flowline configured to direct production fluid flow away from the pumping flowline when the pumping flowline is isolated from the production flowline. In certain embodiments, in response to the expansion of the volume of the first chamber, a fluid pressure of the pumping flowline is decreased. In certain embodiments, the fluid system further comprises a second flowline in fluid communication with the first chamber of the cylinder and the pumping flowline, the second flowline comprising a second flowline valve. In some embodiments, in response to a pressurization of the second chamber of the cylinder via second port, the piston is displaced in a second direction opposite the first direction to reduce a volume of the first chamber of the cylinder. In some embodiments, in response to the reduction of the volume of the first chamber, a fluid pressure of the pumping flowline is increased. In certain embodiments, in response to the pressurization of the second chamber via the second port, a fluid flow is produced between the first chamber of the cylinder and the production flowline while the first chamber of the cylinder is sealed from the pumping flowline.

An embodiment of a fluid system comprises a pumping flowline, wherein the pumping flowline is in selectable fluid communication with a production flowline, a cylinder comprising a first port, a second port, a third port, and a partition disposed within the cylinder, a piston slidably disposed in the cylinder, the piston sealing against an inner surface of the cylinder to form a first chamber, a second chamber, and a third chamber, wherein the first chamber is in fluid communication with the first port, the second chamber is in fluid communication with the second port, and the third chamber is in fluid communication with the third port, and a first flowline in fluid communication with the third port and the production flowline, wherein, in response to a pressurization of the second chamber via the second port, the piston is displaced through the cylinder in a first direction expanding the volume of the third chamber. In some embodiments, the pumping flowline comprises a compressor or a pump. In some embodiments, the fluid system further comprises a bypass flowline configured to direct production fluid flow away from the pumping flowline when the pumping flowline is isolated from the production flowline. In certain embodiments, in response to the expansion of the volume of the third chamber, a fluid pressure of the pumping flowline is decreased. In certain embodiments, in response to a pressurization of the first chamber via the first port, the piston is displaced through the cylinder in a second direction opposite the first direction reducing the volume of the third chamber. In some embodiments, in response to the reduction of the volume of the third chamber, the fluid pressure of the pumping flowline is increased. In some embodiments, the fluid system further comprises a second flowline in fluid communication with the third port and the production flowline. In certain embodiments, in response to a pressurization of the first chamber via the first port, a fluid flow is produced from the third chamber to the production flowline while the third chamber of the cylinder is sealed from the pumping flowline. In certain embodiments, the fluid system further comprises an inhibitor flowline in fluid communication with the third chamber of the cylinder, the inhibitor flowline configured to provide a hydrate inhibitor to the third chamber. In some embodiments, the fluid system further comprises a pump in fluid communication with the first chamber via the first port, wherein, in response to a pressurization of the first chamber via actuation of the pump; the piston is displaced through the cylinder in a second direction opposite the first direction to reduce the volume of the third chamber.

An embodiment of a method for preventing the formation of hydrates in a fluid system comprises fluidically isolating a pumping flowline from a production flowline, opening a valve of a first flowline in fluid communication with a first port of a cylinder and the production flowline, displacing a piston through the cylinder in a first direction in response to opening the valve of the first flowline, and decreasing a fluid pressure of the pumping flowline in response to displacing the piston through the cylinder in the first direction. In some embodiments the method further comprises expanding a volume of a first chamber of the cylinder extending between the first port and the piston in response to displacing the piston in the first direction. In some embodiments the method further comprises pressurizing a second chamber of the cylinder extending between a second port of the cylinder and the piston, and displacing the piston in a second direction opposite the first direction to reduce the volume of the first chamber in response to the pressurization of the second chamber. In certain embodiments the method further comprises increasing the fluid pressure of the pumping flowline in response to displacing the piston in the second direction. In certain embodiments the method further comprises flowing a fluid from the first chamber of the cylinder to the production flowline in response to displacing the piston in the second direction.

BRIEF DESCRIPTION OF THE DRAWINGS

The subject disclosure is further described in the following detailed description, and the accompanying drawings and schematics of non-limiting embodiments of the subject disclosure. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
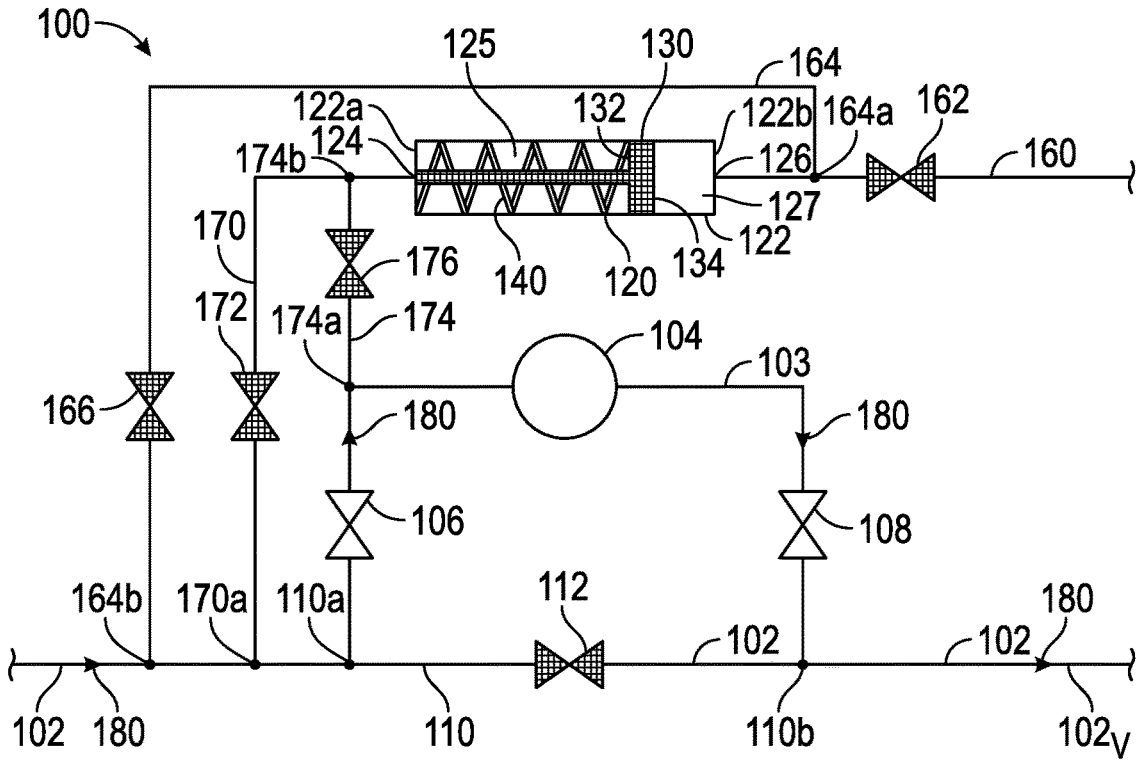
FIG. 1 is a schematic block diagram of an embodiment of a fluid system in accordance with principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Referring to FIG. 1, an embodiment of a fluid system or pumping station 100 is shown schematically in a block diagram. In some embodiments, pumping station 100 comprises a subsea compressor pumping station of a subsea hydrocarbon processing and/or production system. In other embodiments, pumping station 100 comprises a pumping station of a hydrocarbon pipeline system. In the embodiment shown in FIG. 1, pumping station 100 includes a production flowline 102, and a pumping flowline 103 comprising a hydraulic actuator or compressor 104, a first isolation valve 106, and a second isolation valve 108. Compressor 104 is disposed between first isolation valve 106 and second isolation valve 108 and is configured to control the flow of production fluid via selectably pressurizing the production fluid flowing through pumping flowline 103. Although in this embodiment pumping flowline 103 comprises compressor 104, in other embodiments, pumping flowline 103 may include other equipment than compressor 104 disposed between valves 106 and 108. For instance, in other embodiments the hydraulic actuator 104 (described as a compressor 104 herein) may comprise a multiphase pump, a single phase pump, or a wet gas compressor. In still other embodiments, pumping flowline 103 may not include any equipment disposed between valves 106 and 108. The production flowline 102 includes a bypass section or flowline 110 extending between a first bypass connection 110*a* and a second bypass connection 110*b*, the bypass flowline 110 comprising a bypass or non-return valve 112 disposed between connections 110*a* and 110*b* and configured to direct a production fluid flow away from pumping flowline 103 when flowline 103 is isolated from production flowline 102. Bypass connections 110*a* and 110*b* fluidically connect bypass line 110 of production flowline 102 in parallel with pumping flowline 103. While in this embodiment pumping station 100 includes bypass flowline 110, in other embodiments, station 100 may not include flowline 110.

In the embodiment shown in FIG. 1, pumping system 100 includes a fluid displacer 120 comprising a cylinder 122, a piston 130 slidably disposed within the cylinder 122, and a biasing member 140 configured to apply a biasing force against the slidable piston 130. Cylinder 122 of fluid displacer 120 includes a first end 122*a*, a second end 122*b*, a first port 124 disposed at first end 122*a*, and a second port 126 disposed second end 122*b*. Piston 130 of fluid displacer 120 includes a first face 132 facing the first end 122*a* of cylinder 122, and a second face 134 facing the second end 122*b* of cylinder 122. In this embodiment, biasing member 140 is disposed in cylinder 122 and extends between the first end 122*a* of cylinder 122 and the first face 132 of piston 130. In other embodiments, biasing member 140 may extend between second face 134 of piston 130 and the second end 122*b* of cylinder 122. In this arrangement, biasing member 140 is configured to apply a biasing force against piston 130 in the direction of second end 122*b* of cylinder 122. In this configuration, an outer annular surface of piston 130 sealingly engages an inner surface of cylinder 122, dividing the internal volume of cylinder 122 into a first chamber 125 extending between first end 122*a* of cylinder 122 and the first face 132 of piston 130, and a second chamber 127 extending between the second end 122*b* of cylinder 122 and the second face 134 of piston 130. First chamber 125 is in fluid communication with first port 124 while second chamber 127 is in fluid communication with second port 126. Given the sealing engagement between piston 130 and cylinder 122, fluid communication between first chamber 125 and second chamber 127 is restricted.

In the embodiment shown in FIG. 1, pumping station 100 includes an inhibitor inlet flowline 160 in fluid communication with the second chamber 127 of cylinder 122 via the second port 126, where inlet flowline 160 comprises an inlet valve 162 for controlling the flow of fluid through inlet flowline 160. As will be described further herein, inhibitor inlet flowline 160 is in fluid communication with pressurized inhibitor fluid. In some applications, inhibitor fluid comprises hydrate inhibitor fluid, such as methanol. However, in other embodiments, the inhibitor fluid of inlet flowline 160 may comprise various types of fluids like monoethylene glycol (MEG), kinetic hydrate inhibitors (KHI), anti agglomerants (AA), etc. configured to inhibit the formation of hydrates. In addition, pumping station 100 includes an inhibitor outlet flowline 164 in fluid communication with the production flowline 102 and the inhibitor inlet flowline 160, where outlet flowline 164 comprising an outlet valve 166 for controlling the flow of fluid through outlet flowline 164. Particularly, inhibitor outlet flowline extends between an inhibitor flowline connection 164*a* disposed between inlet valve 162 and first port 126 of cylinder 122, and a production flowline connection 164*b* disposed upstream of bypass flowline 110.

Pumping station 100 further includes a depressurization outlet flowline 170 that is in fluid communication with the first chamber 125 of cylinder 122, via first port 124, and production flowline 102, via a production flowline connection 170*a* disposed between the production flowline connection 164*b* of outlet flowline 164 and the bypass flowline 110. Depressurization outlet flowline 170 comprises a depressurization outlet valve 172 for controlling fluid flow through outlet flowline 170. Additionally, station 100 includes a depressurization inlet flowline 174 in fluid communication with depressurization outlet flowline 170 and production flowline 102, where inlet flowline 174 comprises a depressurization inlet valve 176 for controlling flow therethrough. Specifically, depressurization inlet flowline 174 extends between a production flowline connection 174*a* disposed between first isolation valve 106 and compressor 104, and an outlet flowline connection 174*b* disposed between the first port 124 of cylinder 122 and the outlet flowline valve 172.

Referring to FIGS. 1-4, FIG. 1 schematically illustrates pumping station 100 in a first or pumping position with production fluid flowing along a first fluid flowpath 180. Particularly, in the pumping position of station 100, bypass valve 112 is disposed in a closed position while isolation valves 106 and 108 are each disposed in an open position. Also, valves 162, 166, 172, and 176 are each disposed in a closed position restricting fluid flow therethrough. In this configuration, production fluid flowpath 180 extends from production flowline 102 to pumping flowline 103 via connection 110*a*, passing through compressor 104 and isolation valves 106 and 108, and returning to production flowline 102 via connection 110*b*. Further, the closures of valves 166, 172, and 176 restrict fluid communication between the production fluid and cylinder 122.

In some applications, pumping station 100 may be placed in an "offline" position and isolated from production flowline 102 for extended periods of time. For example, flowrate conditions within production flowline 102 may render the additional pressurization provided by compressor 104 of pumping station 100 temporarily unnecessary. As shown for example in FIGS. 2 and 3, when pumping station 100 is placed offline, isolation valves 106 and 108 are closed while bypass valve 112 is opened, providing a bypass production flowpath 182 flowing through bypass flowline 110 of production flowline 102. The closure of isolation valves 106 and 108 isolates pumping flowline 103 from the production fluid flowing along the bypass flowpath 182 comprising production flowline 102.

In some embodiments, when pumping station 100 is disposed in the offline position, fluid pressure may gradually increase within pumping flowline 103 in response to gradual leakage of pressurized fluid from compressor 104 into pumping flowline 103. In some embodiments, compressor 104 may comprise an electric motor including one or more mechanical seals that are pressurized via a barrier fluid to prevent fluid within pumping flowline 103 from short circuiting or otherwise damaging the electric motor of compressor 104. In this manner, the pressurized barrier fluid acts as a "barrier" or positive pressure gradient ensuring that leakage across the mechanical seals flows into, and not out of, production flowline 102. However, over time the possible leakage or consumption of barrier fluid across the mechanical seals of compressor gradually pressurizes pumping flowline 103 by increasing the amount of fluid disposed within flowline 103. Moreover, the pressurization of pumping flowline 103 increases the risk of the formation of hydrate crystals within pumping flowline 103 by decreasing the hydrate formation temperature for fluid disposed within flowline 103. Particularly, with sufficient pressurization of flowline 103 the hydrate formation temperature may drop below the ambient temperature of fluid disposed in flowline 103, causing the formation of hydrates within pumping station 100. Further, even in applications where a pressure build up does not take place within pumping flowline 103, hydrate crystals may still form in response to a sufficiently large degree of temperature drop of fluid disposed in flowline 103.

In order to prevent or mitigate the risk of hydrate formation within pumping station 100, fluid pressure within pumping flowline 103 may be decreased to, in-turn, elevate the hydrate formation temperature for fluid disposed in pumping station 100. In the embodiment shown in FIGS. 1-3, pumping station 100, and particularly pumping flowline 103, may be depressurized while maintaining fluid flow along bypass production flowpath 182. In other words, pumping station 100 is configured to provide for the depressurization of pumping flowline 103 while maintaining the isolation of pumping flowline 103 from bypass production flowpath 182. In this embodiment, offline pumping station 100 is depressurized in response to the displacement of piston 130 within cylinder 122, which increases or decreases (depending upon the direction of travel of piston 130) the respective volumes of first chamber 125 and second chamber 127.

Figure 2:
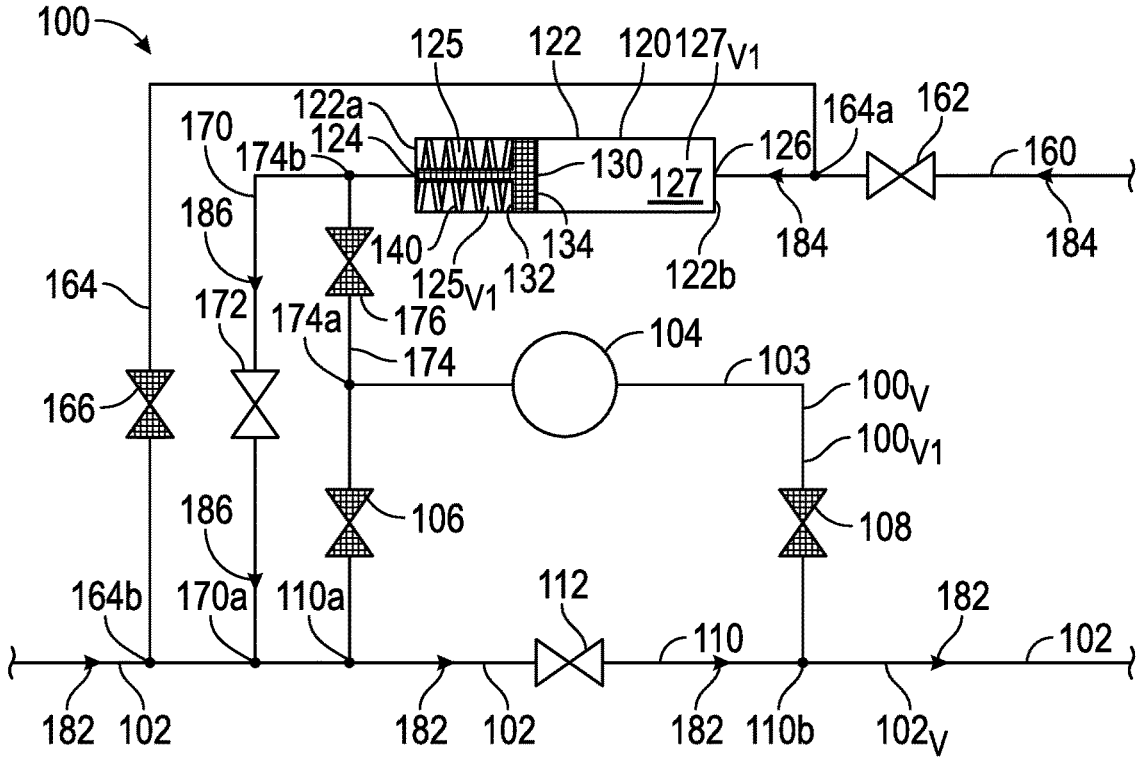
FIG. 2 is a schematic block diagram of the fluid system of FIG. 1 illustrating a depressurization system of the fluid system disposed in a first position.

As shown particularly in FIG. 1, with valves 162, 172, and 176 each disposed in the closed position, the biasing force provided by biasing member 140 against the first face 132 of piston 130 disposes piston 130 proximal the second end 122*b* of cylinder 122 and distal the first end 122*a*. FIG. 2 illustrates pumping station 100 in a second or compression position. Specifically, following the isolation of pumping station 100, inhibitor inlet valve 162 and depressurization outlet valve 172 are each actuated into the open position while depressurization inlet valve 176 remains in the closed position. In this arrangement, pressurized inhibitor fluid is flowed through inhibitor inlet flowline 160 and into the second chamber 127 of cylinder 122, as indicated by inhibitor inlet flowpath 184.

The flow of inhibitor fluid pressurizes second chamber 126 and the second face 134 of piston 130, thereby displacing piston 130 towards the first end 122*a* of cylinder 122 until piston 130 occupies a first position where the volume of first chamber 125 is minimized and the volume of second chamber 127 is maximized relative to the volumes of chambers 125 and 127 when piston 130 is disposed in the first position. Thus, when piston 130 is disposed in the first position, first chamber 125 comprises a first volume $\mathbf{125}_{V1}$ and the second chamber 127 comprises a first volume $\mathbf{127}_{V1}$. In this embodiment, the volume of first chamber 125 is less than the volume of second chamber 127 when piston 130 is disposed in the first position. Fluid disposed within first chamber 125 of cylinder 122 is allowed to flow into production line 102 as piston 130 is displaced through cylinder 122 via a first depressurization flowpath 186 comprising depressurization outlet flowline 170. Thus, the displacement of piston 130 into the first position, and concomitant decrease in volume of first chamber 125, does not apply pressure to pumping flowline 103 given the isolation of flowline 103 provided by closed depressurization inlet valve 176 of inlet flowline 174.

Figure 3:
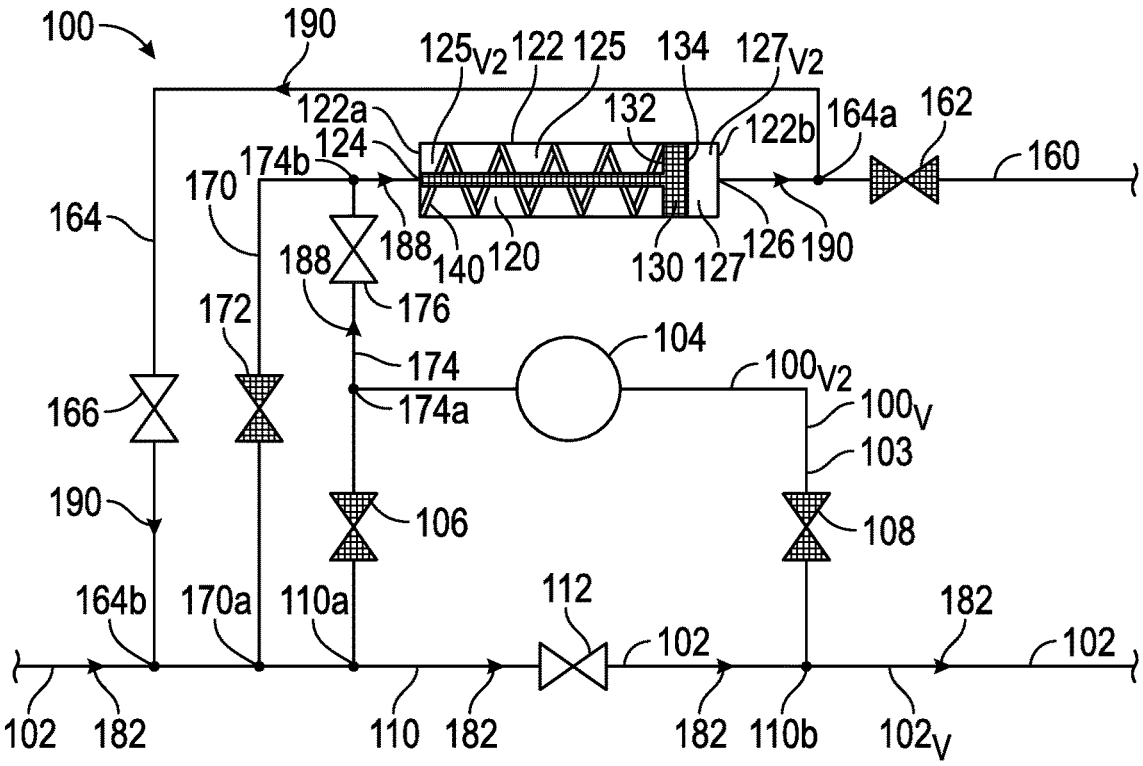
FIG. 3 is a schematic block diagram of the fluid system of FIG. 1 illustrating the depressurization system of the fluid system disposed in a second position.

FIG. 3 illustrates a third or depressurization position of pumping station 100. Specifically, when it is desired to depressurize pumping station 100, and particularly pumping flowline 103, valves 162 and 172 are actuated into the closed position and valves 166 and 176 are actuated into the open position. In this configuration, fluid pressure built up within pumping flowline 103 is released via a second depressurization flowpath 188 extending between depressurization inlet flowline 174 and the first chamber 125 of cylinder 122. Particularly, a portion of the fluid disposed in pumping flowline 103 (as well as fluid disposed in the portion of flowline 174 extending between connection 174*a* and valve 176) is allowed to flow into depressurization outlet flowline 170 via outlet flowline connection 174*b*, and from flowline 170 to first chamber 125 via first port 124.

In response to the fluid flow along second depressurization flowpath 188, piston 130 is displaced through cylinder 122 from the first position shown in FIG. 2 towards second end 122*b*, until piston 130 is disposed in a second position shown in FIG. 3. As piston 130 is displaced from the first position to the second position, the volume of first chamber 125 increases while the volume of second chamber 127 decreases concomitantly with the increase in volume of first chamber 125. Thus, when piston 130 is disposed in the second position, first chamber 125 comprises a second volume $\mathbf{125}_{V2}$ and the second chamber 127 comprises a first volume $\mathbf{127}_{V2}$. In this embodiment, second volume $\mathbf{125}_{V2}$ of first chamber 125 is greater than first volume $\mathbf{125}_{V1}$ while the first volume $\mathbf{127}_{V1}$ of second chamber 127 is greater than the second volume $\mathbf{127}_{V2}$. Fluid disposed in second chamber 127 is allowed to flow into production flowline 102 as piston 130 is displaced from the first position to the second position. Particularly, the fluid disposed in the portion of inhibitor outlet flowline 164 extending between connection 164*a* and valve 166 (as well as fluid disposed in inlet flowline 160 extending between second port 126 of cylinder 122 and valve 162) flows along an inhibitor dump fluid flowpath 190 extending between second port 126 of cylinder 122 and the production flowline connection 164*b* of inhibitor outlet flowline 164. In certain embodiments, the actuation of the valves of pumping station 100 described above may be accomplished via a remotely operated underwater vehicle (ROV). In other embodiments, the actuation of the valves of pumping station 100 may be accomplished remotely, via hydraulic or electrical lines extending to the surface. In further embodiments, pumping station 100 may be temporarily connected to production flowline 102 via a ROV, and may be subsequently disconnected from flowline 102 via the ROV.

As described above, the opening of valves 166 and 176 and the subsequent displacement of piston 130 from the first position to the second position depressurizes pumping flowline 103 by increasing the total volume available to fluid disposed in flowline 103 while maintaining the same amount of fluid within pumping station 100. In this embodiment, pumping station 100 comprises a volume $\mathbf{100}_V$ (i.e., first volume $\mathbf{100}_V$) that includes the combined volumes of the first chamber 125 of cylinder 122, the portion of depressurization outlet flowline 170 extending between first port 124 of cylinder 122 and valve 172, depressurization inlet flowline 174, and pumping flowline 103. The size or magnitude of volume $\mathbf{100}_V$ varies depending upon the disposition of pumping station 100, and particularly, upon the position of piston 130 within cylinder 122. Specifically, when pumping station 100 is disposed in the compression position shown in FIG. 2, volume $\mathbf{100}_V$ comprises a first volume $\mathbf{100}_{V1}$ that comprises the first volume $\mathbf{125}_{V1}$ of first chamber 125. Conversely, when pumping station 100 is disposed in the depressurization position shown in FIG. 3, volume $\mathbf{100}_V$ of pumping station 100 comprises a second total volume $\mathbf{100}_{V2}$ that comprises the second volume $\mathbf{125}_{V2}$ of first chamber 125. Given that second volume $\mathbf{125}_{V2}$ of first chamber 125 is greater than the first volume $\mathbf{125}_{V1}$, the second volume $\mathbf{100}_{V2}$ of pumping station 100 is greater than the first volume $\mathbf{100}_{V1}$. Moreover, because the first volume $\mathbf{100}_{V1}$ of station 100 comprises the same amount of mass (i.e., fluid) as second volume $\mathbf{100}_{V2}$, fluid pressure within second volume $\mathbf{100}_{V2}$ of station 100 is less than the fluid pressure within first volume $\mathbf{100}_{V1}$ of station 100.

As described above, an embodiment of a method depressurizing pumping station 100 includes fluidically isolating a first volume (e.g., volume 100V) from a second volume (e.g., volume 102V), opening a valve of a flowline (e.g., valve 176 of flowline 174) in fluid communication with a first port of a cylinder (e.g., port 124 of cylinder 122) and the second volume, displacing a piston (e.g., piston 130) through the cylinder in a first direction (e.g., towards second end 122*b* of cylinder 122) in response to opening the valve of the flowline, and decreasing a fluid pressure of the first volume in response to displacing the piston through the cylinder in the first direction. In this manner, pumping station 100 is depressurized while remaining isolated or sealed from production flowline 102, thereby providing for the prevention of hydrate formation (via decreasing the hydrate formation temperature in response to decreasing pressure) within pumping station 100 without needing to isolate the entire production flowline 102 or injecting hydrate inhibitor into pumping station 100. Therefore, hydrate prevention is achieved within pumping station 100 without interfering with the operation of production flowline 102 or the additional costs and inconveniences necessitated by the inclusion of a separate inhibitor injection for providing hydrate inhibitor fluid to pumping station 100. Further, once pumping station 100 is disposed in the depressurization position shown in FIG. 3, additional leakage of barrier fluid from compressor 104 into pumping flowline 103 is accounted for by additional displacement of piston 130 towards second end 122*b* of cylinder 122. In other words, the slidable displacement of piston 130 within cylinder 122 allows for continued fluid pressure balancing between the fluid disposed in the volume 100V of pumping station 100 and the fluid flowing through production flowline 102 along bypass production flowpath 182. In this manner, pumping station 100 is configured to continuously prevent the formation of hydrates within pumping flowline 103 even as additional pressurized fluid might gradually leak into flowline 103 from compressor 104.

Figure 4:
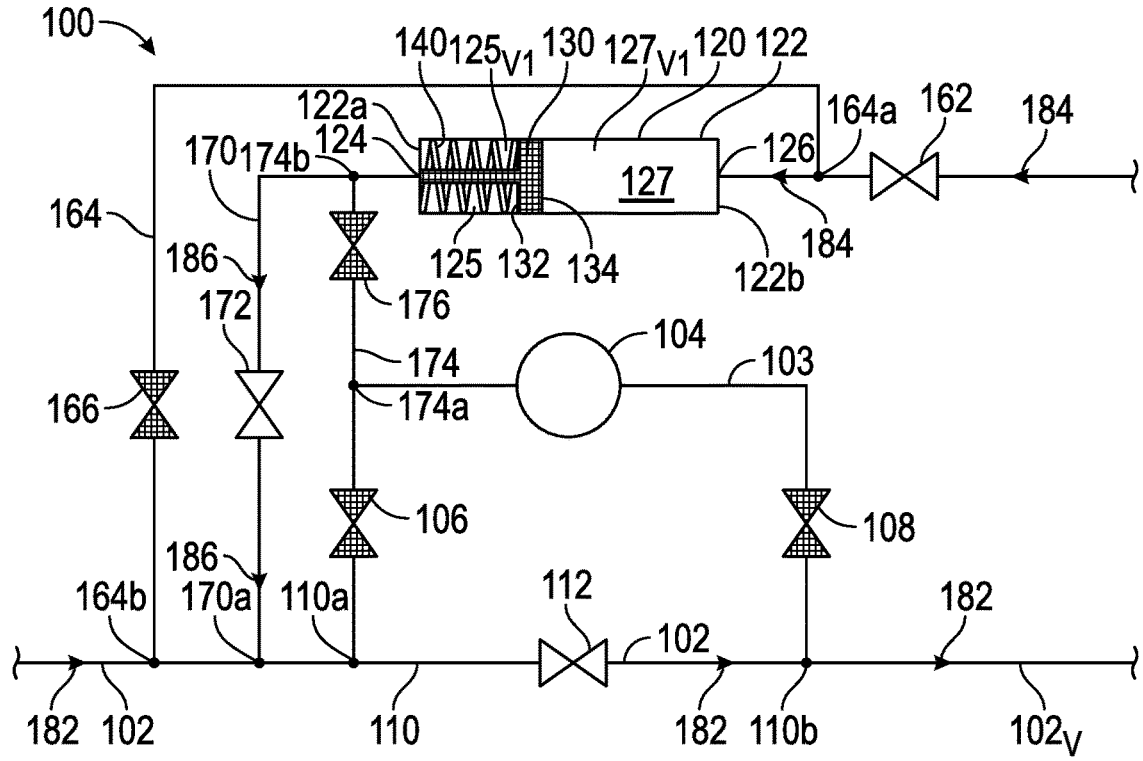
FIG. 4 is a schematic block diagram of the fluid system of FIG. 1 illustrating the depressurization system of the fluid system disposed in a third position.

In this embodiment, pumping station 100 is further configured to remove hydrates from pumping station 100 that have already formed. In other words, pumping station 100 is configured to remove fluid from the volume $\mathbf{100}_V$ of pumping station 100 by pumping the fluid from station 100 into a volume $\mathbf{102}_V$ of production flowline 102 (i.e., second volume $\mathbf{102}_V$) while first volume $\mathbf{100}_V$ remains fluidically isolated from volume $\mathbf{102}_V$ with isolation valves 106 and 108 each disposed in the closed position. In this configuration, volume $\mathbf{102}_V$ of production flowline 102 is in selectable fluid communication with volume $\mathbf{100}_V$ of pumping station 100. In this embodiment, FIG. 4 illustrates pumping station 100 in a fourth or hydrate removal position that may follow the depressurization position of station 100 shown in FIG. 3. In this embodiment, following the displacement of piston 130 into the second position shown in FIG. 3, valve 162 of inhibitor inlet flowline 160 is reopened to provide pressurized fluid to second chamber 127 of cylinder 122 along inlet flowpath 184. In addition, valve 176 of inlet flowline 174 is closed and valve 172 of depressurization outlet flowline 170 is opened, thereby restricting fluid communication between pumping flowline 103 and the first chamber 125 of cylinder 122 and providing for fluid communication between production flowline 102 and first chamber 125.

Specifically, as piston 130 is displaced through cylinder 122 from the second position to the first position, production fluid disposed in first chamber 125 (previously displaced into first chamber 125 from pumping flowline 103 in response to the actuation of station 100 from the depressurization position to the depressurization position) is displaced from first chamber 125 into volume $\mathbf{102}_V$ of production flowline 102 via a hydrate dump flowpath 192 extending along outlet flowline 170 between first port 124 of cylinder 122 and flowline connection 170*a*. In this manner, the total fluid mass disposed within the volume $\mathbf{100}_V$ of pumping station 100 thereby removes hydrates from station 100 and further decreases fluid pressure within volume $\mathbf{100}_V$ of pumping station 100. Moreover, pumping station 100 may be repeatedly actuated between the depressurization position shown in FIG. 3 and the hydrate dump position of FIG. 4 to continually remove hydrates from volume $\mathbf{100}_V$ and thereby depressurize volume $\mathbf{100}_V$. Specifically, station 100 may be cycled from the depressurization position and the dump position to repeatedly dump fluid from the volume $\mathbf{100}_V$ of station 100 by closing valves 162 and 172, and opening valves 166 and 176 to return piston 130 to the second position via the biasing force applied against piston 130 by biasing member 140, thereby returning station 100 to the depressurization position shown in FIG. 3.

Further, flowing fluid between pumping station 100 and production flowline 102 may be used in other contexts than hydrate remediation. For instance, in some applications, pumping station 100 and/or other equipment included in the processing or pipeline system in which station 100 is included, might be subjected to pressure or leak testing in which a substantial pressure differential is formed between pumping flowline 103 of pumping station 100 and production flowline 102 to pressure test the sealing points (e.g., isolation valves 106 and 108, etc.) of pumping station 100. In these applications, the operation of isolation valves 106 and 108 following a pressure test of station 100 may damage valves 106 and 108 due to the substantial pressure differential between pumping flowline 103 and production flowline 102. Moreover, rapid changes in pressure, such as resulting from the opening of valves 106 and 108, may damage seals and other components of compressor 104. Therefore, during a pressure test of station 100, the fluid pressure within station 100 may be gradually increased by injecting fluid into volume $\mathbf{100}_V$ of station 100 by repeatedly actuating station 100.

Figure 5:
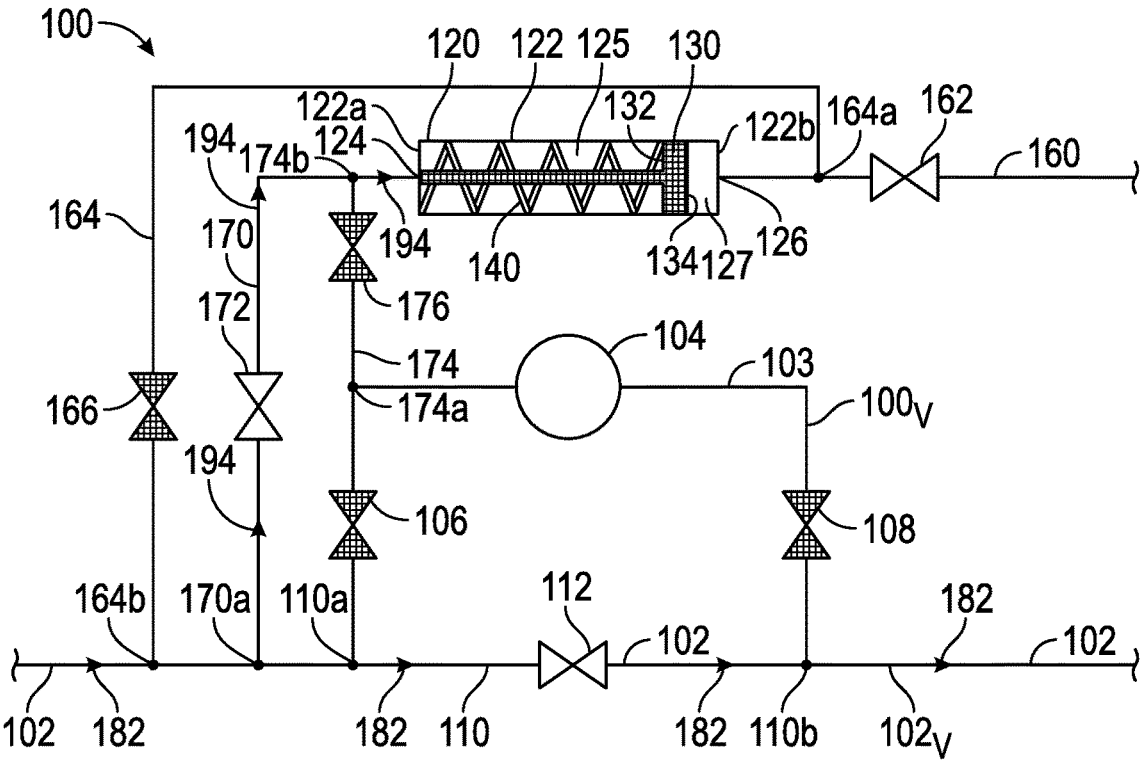
FIG. 5 is a schematic block diagram of the fluid system of FIG. 1 illustrating the depressurization system of the fluid system disposed in a fourth position.
Figure 6:
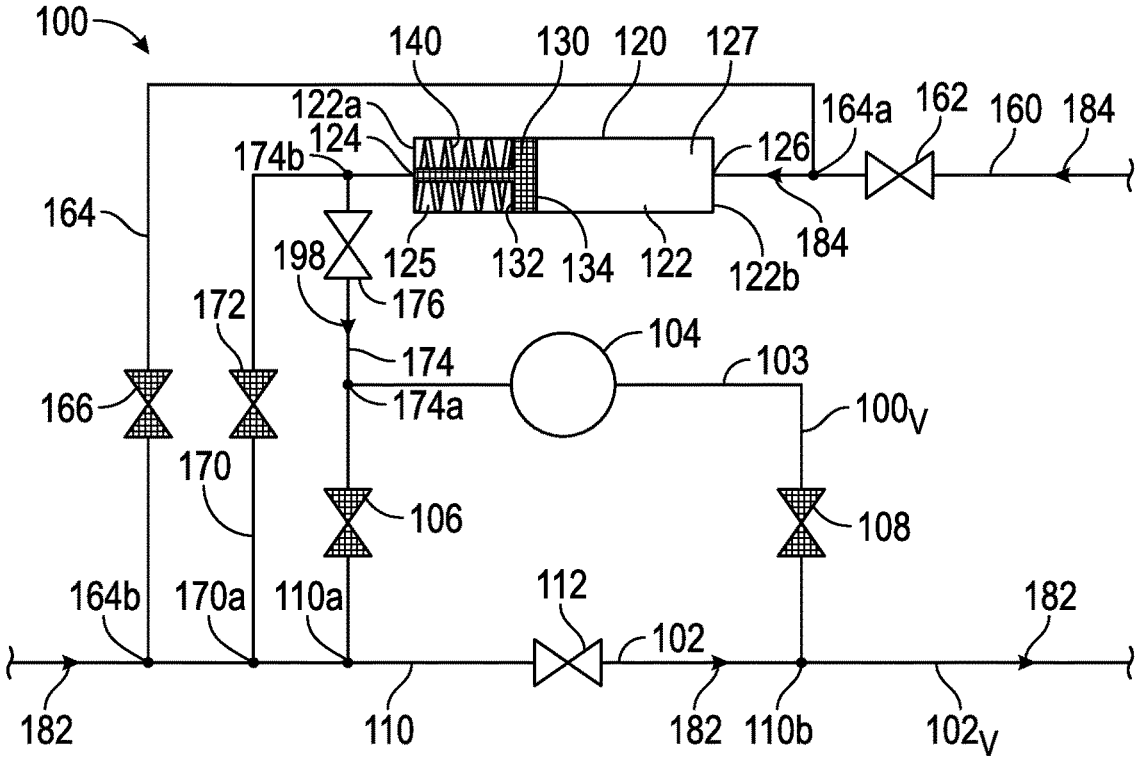
FIG. 6 is a schematic block diagram of the fluid system of FIG. 1 illustrating the depressurization system of the fluid system disposed in a fifth position.

Specifically, with reference to FIGS. 5 and 6, pressure may be gradually increased within the volume $\mathbf{100}_V$ of pumping station 100 by actuating station 100 between a fifth—or extraction position—shown in FIG. 5, and a sixth—or injection position—shown in FIG. 6. With pumping flowline 103 sealed from production flowline 102, station 100 may be disposed in the extraction position by closing valves 166, 176, depressurizing inhibitor inlet flowline 160 by opening valve 162 and releasing fluid disposed therein to a low pressure environment, and opening valve 172 to provide fluid communication between production flowline 102 and the first port 124 of cylinder 122 via depressurization outlet flowline 170. In this configuration, with inlet flow line 160 depressurized, fluid pressure within production flowline 102 and the biasing force provided by biasing member 140 act against piston 130 to displace piston 130 through cylinder 122 and into the second position proximal second end 122*b*. In response to the displacement of piston 130, production fluid flows into flowline 170 and first chamber 125 of cylinder 122 along an extraction flowpath 194 extending between connection 170*a* and first chamber 125. In turn, fluid disposed in second chamber 127 is ejected from cylinder 122 and flows into flowline 160 via second port 126. In some embodiments, fluid disposed in second chamber 127 may be released to the ambient environment.

Following the actuation of pumping station 100 into the extraction position shown in FIG. 5, station 100 may be actuated into the injection position shown in FIG. 6 to increase the amount of fluid within volume $100_V$ of station 100, and thereby increase the fluid pressure within pumping station 100. Specifically, station 100 might be actuated into the injection position by closing valve 172, opening valve 176, and pressurizing inhibitor inlet flowline 160 to produce a fluid flow into second chamber 127 along inhibitor inlet flowpath 184. As fluid enters second chamber 127, piston 130 is displaced from the second position to the first position and fluid previously displaced into first chamber 125 is ejected therefrom, flowing along an injection flowpath 198 between first chamber 125 and pumping flowline 103. Following the injection of pressurized production fluid into pumping flowline 103, valve 176 may be closed and valve 172 opened to actuate pumping station 100 back into the extraction position shown in FIG. 5 to extract additional fluid from production flowline 102. In this manner, pressure within volume $100_V$ of pumping station 100 is gradually increased while remaining isolated from production flowline 102.

In certain embodiments, pressure within volume $100_V$ of pumping station 100 may be continually increased as described above until pressure therein reaches a predetermined testing pressure, at which point pressure testing of pumping station 100 may commence. Following the pressure testing of station 100, pressure may be gradually decreased within $100_V$ of pumping station 100 between the depressurization and dump positions described above, whereby fluid disposed in volume $100_V$ of station 100 is gradually dumped to production flowline 102. As described, pumping station 100 provides a mechanism for gradually increasing and decreasing pressure to eliminate the issues presented with operating valves across substantial differential pressures, or rapidly changing the pressure within pumping station 100.

Figure 7:
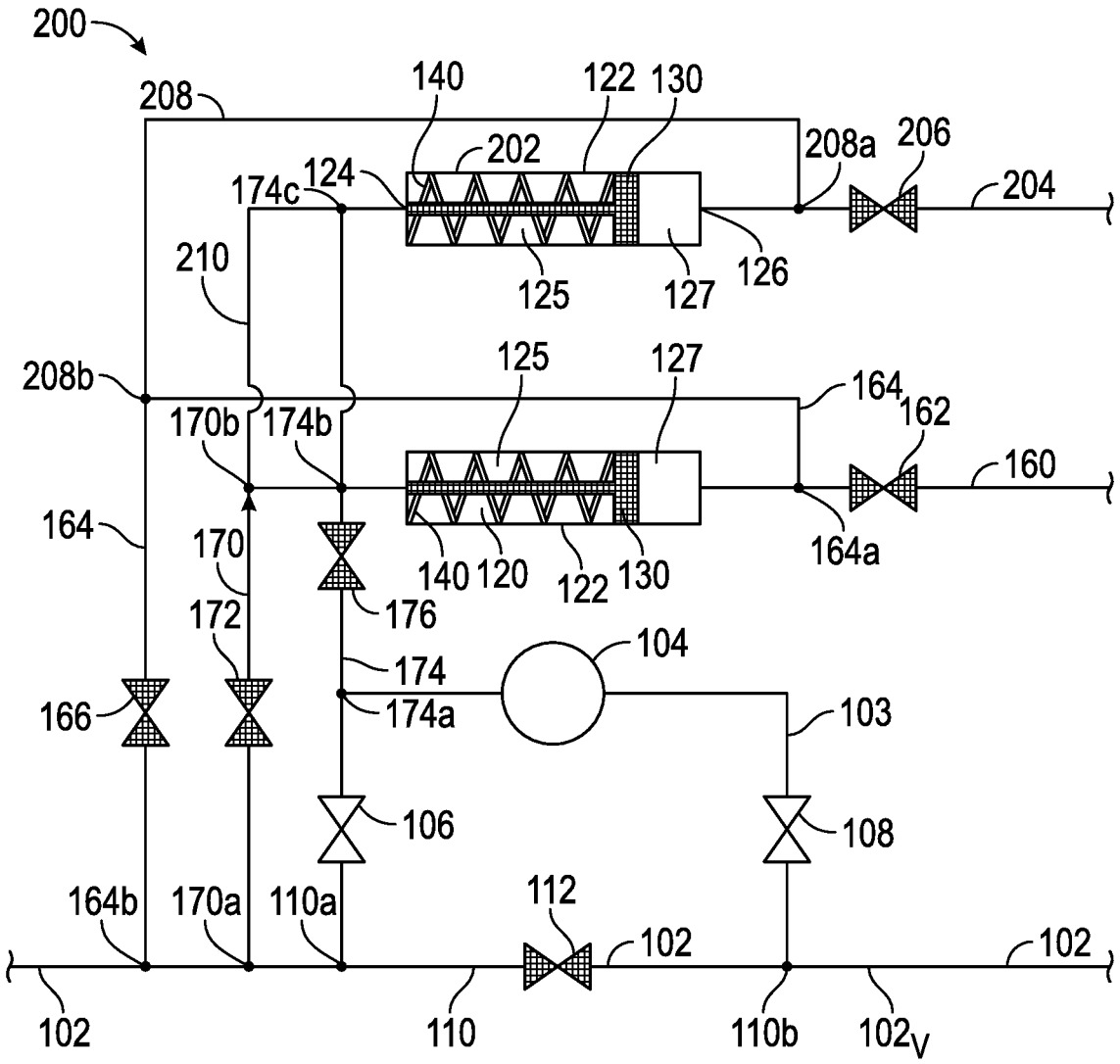
FIG. 7 is a schematic block diagram of another embodiment of a fluid system in accordance with principles disclosed herein.

Referring to FIG. 7, another embodiment of a fluid system or pumping station 200 is schematically illustrated, where pumping station 200 may comprise a subsea compressor pumping station of a subsea hydrocarbon processing and/or production system, or a pumping station of a hydrocarbon pipeline system, as well as other applications. Pumping station 200 includes features in common with pumping station 100 described above, and shared features are labeled similarly. In this embodiment, pumping station 200 includes an additional fluid displacer 202 configured similarly to fluid displacer 120, where fluid displacers 120 and 200 are disposed in parallel to provide additional depressurization capacity for pumping station 200. Particularly, pumping station 200 includes an inhibitor inlet flowline 204 comprising an inhibitor inlet valve 206 that fluidically connects with the second port 126 of fluid displacer 200. Inlet flowline 204 is in fluid communication with a pressurized fluid for pressurizing the cylinder 122 of fluid displacer 200. Pumping station 200 also includes a depressurization outlet flowline 208 extending between inhibitor inlet flowline 204 via an inhibitor inlet connection 208*a*, and outlet flowline 164 via an outlet flowline connection 208*b*.

In addition, station 200 includes a depressurization outlet flowline 210 extending between the first port 124 of fluid displacer 200 and an outlet flowline connection 170*b* in fluid communication with outlet flowline 170. Further, in this embodiment, depressurization inlet flowline 174 includes an outlet depressurization connection 174*c* providing for fluid communication between inlet flowline 174 and outlet flowline 210. In this arrangement, when pumping station 200 is disposed in the depressurization position, in response to the piston 130 of each fluid displacer 120 and 200 being actuated into the second position described above, the volume of pumping station 200 will increase as the first chamber 125 of each fluid displacer 120 and 200 increases. Thus, the increase in volume of station 200, in response to being actuated into the depressurization position, will correspond to the sum of the increase in volume of first chamber 125 of both fluid displacers 120 and 200, thereby doubling the increase in volume of station 200 relative to pumping station 100 described above. Moreover, in other embodiments, additional fluid displacers similar in configuration to fluid displacer 120 may be added in parallel for increased depressurization, depending upon the needs of the application.

Figure 8:
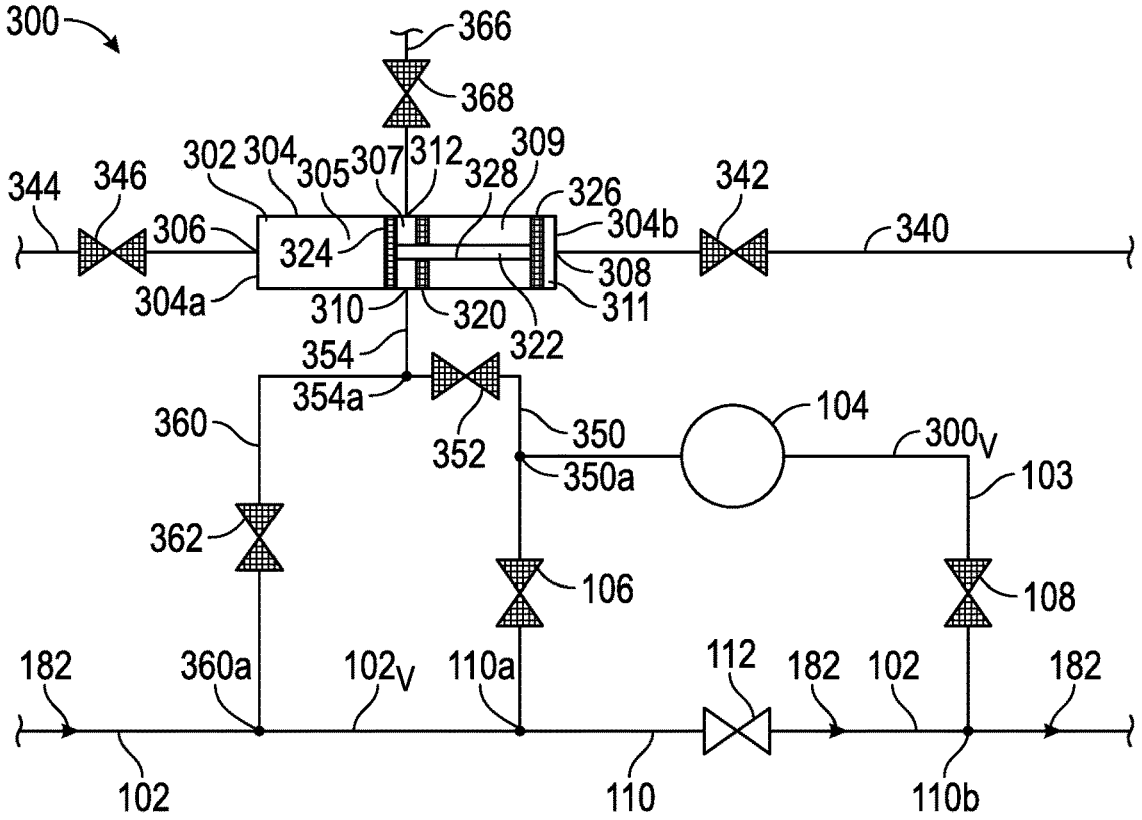
FIG. 8 is a schematic block diagram of another embodiment of a fluid system in accordance with principles disclosed herein.

Referring to FIG. 8, another embodiment of a fluid system or pumping station 300 is schematically illustrated, where pumping station 300 may comprise a subsea compressor pumping station of a subsea hydrocarbon processing and/or production system, or a pumping station of a hydrocarbon pipeline system, as well as other applications. Pumping station 300 includes features in common with pumping station 100 described above, and shared features are labeled similarly. For instance, pumping station 300 includes production flowline 102, isolation valves 106 and 108, compressor 104, and bypass flowline 110 of production flowline 102 with bypass valve 112. In the embodiment shown in FIG. 5, pumping station 300 includes a fluid displacer 302 configured to remove mass or fluid from pumping station 300 in order to prevent the formation of hydrates within station 300, or to remove already formed hydrates from station 300. In this embodiment, fluid displacer 302 includes a cylinder 304, a partition 320 disposed within and affixed to cylinder 304, and a piston 322 slidably disposed within cylinder 304.

Cylinder 304 of fluid displacer 300 includes a first end 304*a*, a second end 304*b*, a first port 306 disposed at first end 304*a*, a second port 308 disposed at second end 304*b*, a third port 310 disposed between ends 304*a* and 304*b*, and a fourth port 312 disposed between ends 304*a* and 304*b*. Piston 322 includes a first pressure flange 324, a second pressure flange 326, and a piston rod 328 extending between and coupling flanges 324 and 326. Rod 328 extends through partition 320, allowing piston 322 to be displaced through cylinder 304. Pressure flanges 324, 326 and partition 320 sealingly engage an inner surface of cylinder 304, dividing cylinder 304 into a first chamber 305 extending between first end 304*a* and first flange 324, a second chamber 307 extending between first flange 324 and partition 320, a third chamber 309 extending between partition 320 and the second flange 326, and a fourth chamber 311 extending between the second flange 326 and the second end 304*b* of cylinder 304. First chamber 305 is in fluid communication with first port 306, second chamber 307 is in fluid communication with ports 310 and 312, and fourth chamber 311 is in fluid communication with port 308. In this embodiment, third chamber 309 is filled with a compressible gas to bias piston 322 towards second end 304*b*, as shown in FIG. 8.

Pumping station 300 also includes an inhibitor inlet flowline 340 in fluid communication with fourth chamber 311 via second port 308 and comprising an inhibitor inlet valve 342. Additionally, pumping station 300 includes an inhibitor outlet flowline 344 in fluid communication with first chamber 305 via first port 306 and comprising an inhibitor outlet valve 346. Inhibitor flowlines 340 and 344 are in fluid communication with pressurized fluid. In some applications, inhibitor fluid comprises hydrate inhibitor fluid, such as methanol. However, in other embodiments, the inhibitor fluid may comprise various types of fluids. A cylinder flowline 354 is in fluid communication with second chamber 307 via third port 310, and fluidically connects with a first depressurization flowline 350 and a second depressurization flowline 360 at a connection 354*a*, where first flowline 350 includes a valve 352 and second flowline 360 includes a valve 362.

In this configuration, first flowline 350 extends between connection 354*a* and an pumping flowline connection 350*a* in fluid communication with pumping flowline 103. Second flowline 360 extends between connection 354*a* and a production flowline connection 360*a* in fluid communication with production flowline 102. In this embodiment, pumping station 300 further includes an inhibitor injector flowline 366 in fluid communication with second chamber 307 via fourth port 312 and comprising an injector valve 368. Injector flowline 366 is configured to selectably inject a hydrate inhibitor (e.g., methanol, etc.) into second chamber 307 of cylinder 304 pressurizing chamber 307, where the inhibitor fluid may be subsequently injected into pumping flowline 103 for hydrate removal and to protect second chamber 307, flowlines 354, 360, and other components of station 300 from hydrate formation. Although the embodiment of station 300 shown in FIG. 8 includes injector flowline 366, in other embodiments, station 300 may not include flowline 366 or fourth port 312.

Pumping station 300 may be utilized to inject or remove fluid from pumping flowline 103 while maintaining the isolation of flowline 103 and compressor 104 from production flowline 102. For example, fluid may be extracted from pumping flowline 103 (and thereby reducing fluid pressure in a volume of flowline 103) by opening valves 342, 346, and 352, depressurizing flowline 344, and pressurizing flowline 340 and fourth chamber 311 to displace piston 322 through cylinder 304 towards first end 304*a*. The displacement of piston 322 towards first end 304*a* decreases the volume of first chamber 305 and third chamber 309, while increasing the volume of second chamber 307 and fourth chamber 311. The displacement of piston 322 towards first end 304*a* of cylinder 304 increases a volume $\mathbf{300}_V$ of pumping station 300, where volume $\mathbf{300}_V$ comprises the combined volumes of pumping flowline 103, flowline 350, and second chamber 307. Thus, the increase in volume $\mathbf{300}_V$ of pumping station 300 decreases the fluid pressure therein, inhibiting hydrate formation.

The production fluid collected within second chamber 307 may be subsequently injected into production flowline 102 by closing valve 352, opening valve 362, pressurizing flowline 344 and first chamber 305, and depressurizing flowline 340. In this configuration, inhibitor fluid is injected into first chamber 305 of cylinder 304 from flowline 344 while fluid is ejected from fourth chamber 311 into flowline 340 in response to the pressurization of flowline 344 and depressurization of flowline 340. Further, production fluid disposed in second chamber 307 is ejected therefrom, flowing into production flowline 102 via flowline 360. Piston 322 may be repeatedly actuated as described above to gradually decrease fluid pressure within the volume $\mathbf{300}_V$ of pumping station 300. Further, pressure within volume $\mathbf{300}_V$ of pumping station 300 may be gradually increased by expanding the volume of second chamber 307 via flowlines 340 and 344 while valve 362 is open and valve 352 is closed, thereby displacing fluid from production flowline 102 into second chamber 307 via flowline 360. Subsequently, piston 322 may be displaced in the opposing direction after valve 362 has been closed and valve 350 opened, thereby injecting fluid from second chamber 307 into pumping flowline 103. This process may be repeated to gradually increase fluid pressure within the volume $\mathbf{300}_V$ of pumping station 300, such as in the event of a pressure test of pumping station 300.

In some embodiments, first chamber 305 may be filled with a compressible gas to bias piston 322 towards the second end 304*b* of cylinder 304, instead of being filled with a fluid from flowline 344. In this embodiment, pumping station 300 would not include flowline 344, and instead, first chamber 305 would be fluidically sealed. Further, in this embodiment the compressible fluid disposed in first chamber 305 and third chamber 309 would be at a lower fluid pressure than the fluid disposed in production flowline 102, and a target fluid pressure (i.e., reduced fluid pressure) of pumping flowline 103.

Figure 9:
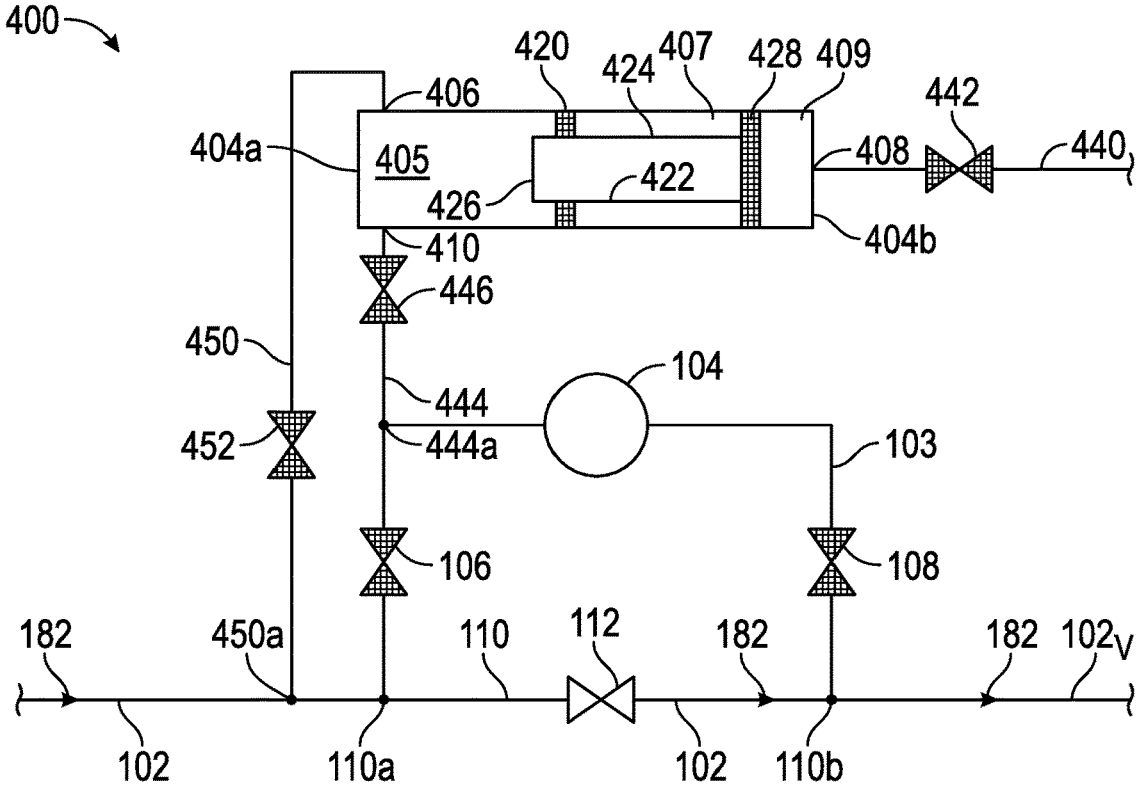
FIG. 9 is a schematic block diagram of another embodiment of a fluid system in accordance with principles disclosed herein.

Referring to FIG. 9, another embodiment of a fluid system or pumping station 400 is schematically illustrated, where pumping station 400 may comprise a subsea compressor pumping station of a subsea hydrocarbon processing and/or production system, or a pumping station of a hydrocarbon pipeline system, as well as other applications. Pumping station 400 includes features in common with pumping station 100 described above, and shared features are labeled similarly. For instance, pumping station 400 includes production flowline 102, isolation valves 106 and 108, compressor 104, and bypass flowline 110 of production flowline 102 with bypass valve 112. In the embodiment shown in FIG. 9, pumping station 400 includes a fluid displacer 402 configured to remove mass or fluid from pumping station 400 in order to prevent the formation of hydrates within station 400, or to remove already formed hydrates from station 400. In this embodiment, fluid displacer 402 includes a cylinder 404, a partition 420 disposed within and affixed to cylinder 404, and a piston 422 slidably disposed within cylinder 404.

Cylinder 404 of fluid displacer 400 includes a first end 404*a*, a second end 404*b*, a first port 406 disposed at first end 404*a*, a second port 408 disposed at second end 404*b*, and a third port 410 disposed at first end 404*a*. Piston 422 includes a piston cylinder 424 having an open end 426 and a pressure flange 428 coupled to a closed end of cylinder 424 opposite open end 426. Piston cylinder 424 extends through partition 420, allowing piston 422 to be displaced through cylinder 404. Pressure flange 428 and partition 420 sealingly engage an inner surface of cylinder 404, dividing cylinder 404 into a first chamber 405 extending between first end 404*a* and partition 420, a second chamber 407 extending between partition 420 and flange 428, and a third chamber 409 extending between flange 428 and the second end 404*b* of cylinder 404. First chamber 405 is in fluid communication with ports 406 and 410 while third chamber 409 is in fluid communication with port 408. In this embodiment, second chamber 407 is filled with a compressible gas to bias piston 422 towards second end 404*b*, as shown in FIG. 9. In this arrangement, fluid communication is provided between first chamber 405 of cylinder 404 and an internal chamber of piston cylinder 424.

Pumping station 400 also includes an inhibitor flowline 440 in fluid communication with third chamber 409 via second port 408 and comprising an inhibitor valve 442. Inhibitor flowline 440 is in selectable fluid communication with pressurized inhibitor fluid, but may be depressurized to allow for the dumping of fluid disposed in third chamber 409. In some applications, inhibitor fluid comprises hydrate inhibitor fluid, such as methanol. However, in other embodiments, the inhibitor fluid may comprise various types of fluids. In this embodiment, station 400 includes a first depressurization flowline 444 and a second depressurization flowline 450, where first flowline 444 includes a valve 446 and second flowline 450 includes a valve 452. In this configuration, first flowline 444 extends between first chamber 405 via third port 410 and a pumping flowline connection 444*a* in fluid communication with pumping flowline 103. Second flowline 450 extends between first chamber 405 via first port 406 and a production flowline connection 450*a* in fluid communication with production flowline 102.

Pumping station 400 may be utilized to inject or remove fluid from pumping flowline 103 while maintaining the isolation of flowline 103 and compressor 104 from production flowline 102. For example, fluid may be extracted from pumping flowline 103 by opening valve 446, thereby providing fluid communication between pumping flowline 103 and the first chamber 405 of cylinder 404 and allowing pressurized fluid within pumping flowline 103 to flow into first chamber 405 of cylinder 404. Subsequently, valve 446 may be closed and valves 452 and 442 may be opened while flowline 440 is pressurized to thereby displace piston 422 towards first end 404*a* and eject the production fluid collected in first chamber 405 into production flowline 102 via flowline 450. The removal of fluid disposed in pumping flowline 103 thereby depressurizes flowline 103 and pumping station 400. Following the ejection of fluid from first chamber 405 to production flowline 102, valve 442 may be opened and flowline 440 depressurized to allow fluid disposed in third chamber 409 to release to a low pressure environment, allowing gas disposed in second chamber 407 to displace piston 422 towards the second end 404*b* of cylinder 404.

Figure 10:
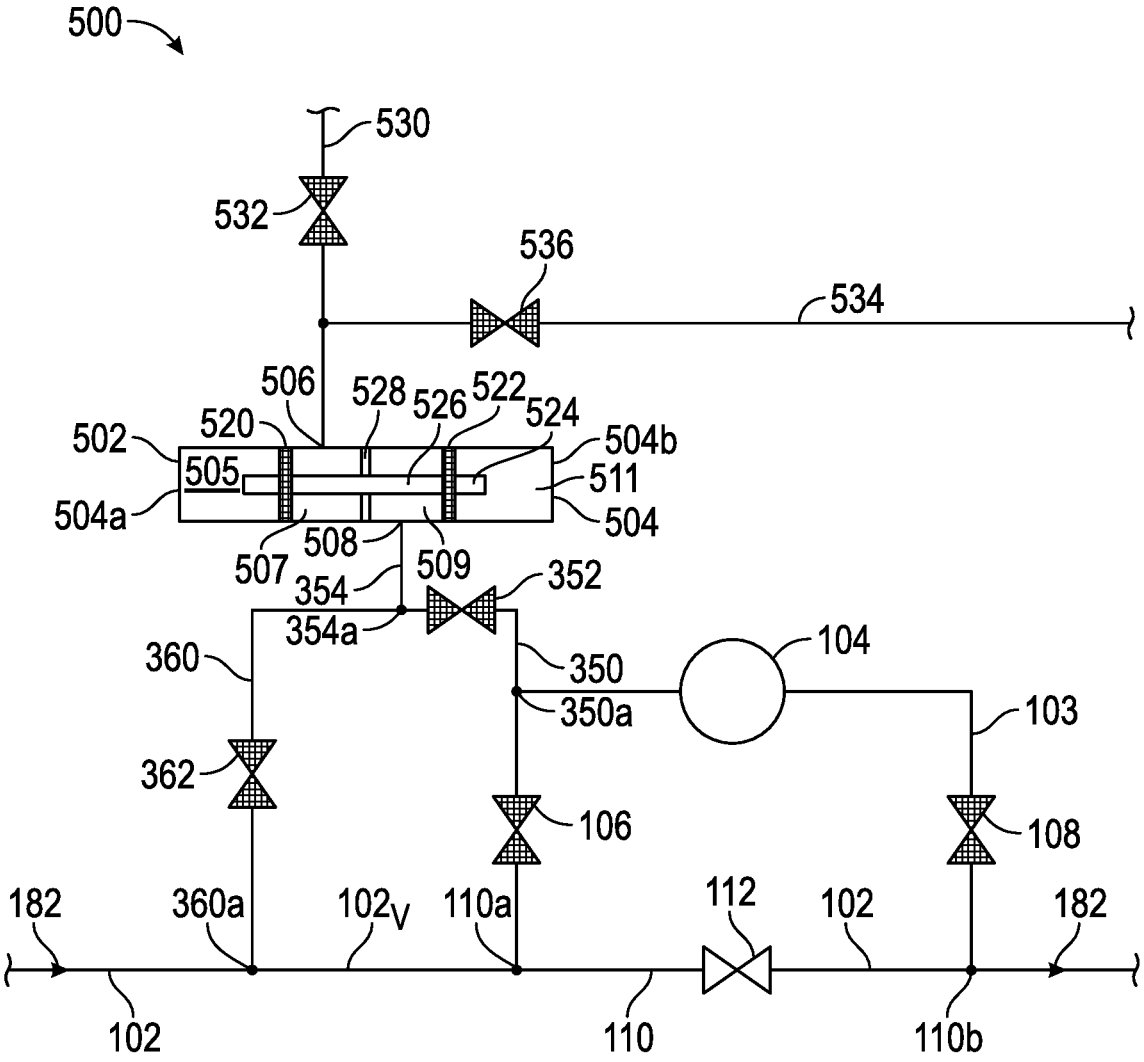
FIG. 10 is a schematic block diagram of another embodiment of a fluid system in accordance with principles disclosed herein.

Referring to FIG. 10, another embodiment of a fluid system or pumping station 500 is shown, where pumping station 500 includes many features in common with pumping station 300 described above, with shared features labeled similarly. In this embodiment, pumping station 500 includes a fluid displacer 502 configured to remove mass or fluid from pumping station 500 in order to prevent the formation of hydrates within station 500, or to remove already formed hydrates from station 500. In this embodiment, fluid displacer 502 includes a cylinder 504, a first partition 520 disposed within and affixed to cylinder 504, a second partition 522 also affixed to cylinder 504, and a piston 524 slidably disposed within cylinder 504.

Cylinder 504 of fluid displacer 500 includes a first end 504*a*, a second end 504*b*, a first port 506, and a second port 508, where ports 506 and 508 are disposed between partitions 520 and 522. Piston 524 includes a piston rod 526 and a pressure flange 528 extending radially outwards from rod 526, where an outer surface of flange 528 sealingly engages an inner surface of cylinder 504. Rod 526 extends through first partition 520 and second partition 522, allowing piston 524 to be displaced through cylinder 504. Partitions 520, 522, and flange 528 of piston 524 divides cylinder 504 into a first chamber 505 extending between first end 504*a* and first partition 520, a second chamber 507 extending between first partition 520 and flange 528, a third chamber 509 extending between flange 528 and second partition 522, and a fourth chamber 511 extending between second partition 522 and the second end 504*b* of cylinder 504. Second chamber 507 is in fluid communication with port 506 while third chamber 509 is in fluid communication with port 508.

In this embodiment, first chamber 505 and fourth chamber 511 are each filled with a compressible gas configured to assist in displacing piston 524 towards first end 504*a* of cylinder 504 during operation of fluid displacer 502. Thus, in certain embodiments, gas in fourth chamber 511 is disposed at a greater pressure than gas disposed in first chamber 505. Second chamber 507 is in fluid communication with an inhibitor pressurization line 530 via first port 506, where pressurization line 530 includes a pressurization valve 532. In this embodiment, an inhibitor dump line 534 extends from pressurization line 530 and includes a dump valve 536; however, in other embodiments, only a single inhibitor line 530 may be included. Pressurization line 530 is in fluid communication with a pressurized fluid source, such as water or a hydrate inhibitor fluid. Additionally, cylinder flowline 354 is in fluid communication with third chamber 509 of cylinder 504 via second port 508.

In this configuration, pumping station 500 and fluid displacer 502 are configured to displace fluid between a volume of pumping flowline 103 and volume $\mathbf{102}_V$ production flowline 102 while maintaining isolation of pumping flowline 103 from production flowline 102. Particularly, to displace fluid from pumping flowline 103 valves 536 and 352 may be opened (while valves 532 and 362 are maintained in the closed position), allowing fluid from pumping flowline 103 to be displaced into third chamber 509 of cylinder 504 and for fluid disposed in second chamber 507 to be dumped from cylinder 504 via flowline 534. The displacement of fluid from pumping flowline 103 into third chamber 509 displaces piston 524 towards first end 504*a* of cylinder 504 (assisted by a pressure force against piston 524 from gas disposed in fourth chamber 511), increasing the volume of third chamber 509 and decreasing the volume of second chamber 507 and first chamber 505, compressing gas disposed in first chamber 505. Subsequently, valves 352 and 536 are closed while valves 362 and 532 are opened, thereby displacing pressurized fluid into second chamber 507 via flowline 530 and displacing fluid disposed in third chamber 509 to production flowline 102 via flowline 360 in response to displacement of piston 524 towards the second end 504*b* of cylinder 504.

Conversely, fluid may be displaced from production flowline 102 to pumping flowline 103 by opening valves 362 and 536 while valves 532 and 352 are closed, allowing fluid to flow into third chamber 509 of cylinder 504 via flowline 360 and for fluid disposed in second chamber 507 to be dumped via flowline 534 in response to displacement of piston 524 towards first end 504*a* of cylinder 504 (assisted by a pressure force against piston 524 from gas disposed in fourth chamber 511). Subsequently, valves 362 and 536 are closed while valves 532 and 352 are opened, supplying pressurized fluid to second chamber 507 via flowline 530 and displacing fluid from third chamber 509 to pumping flowline 103 via flowline 350 in response to displacement of piston 524 towards second end 504*b* of cylinder 504.

Figure 11:
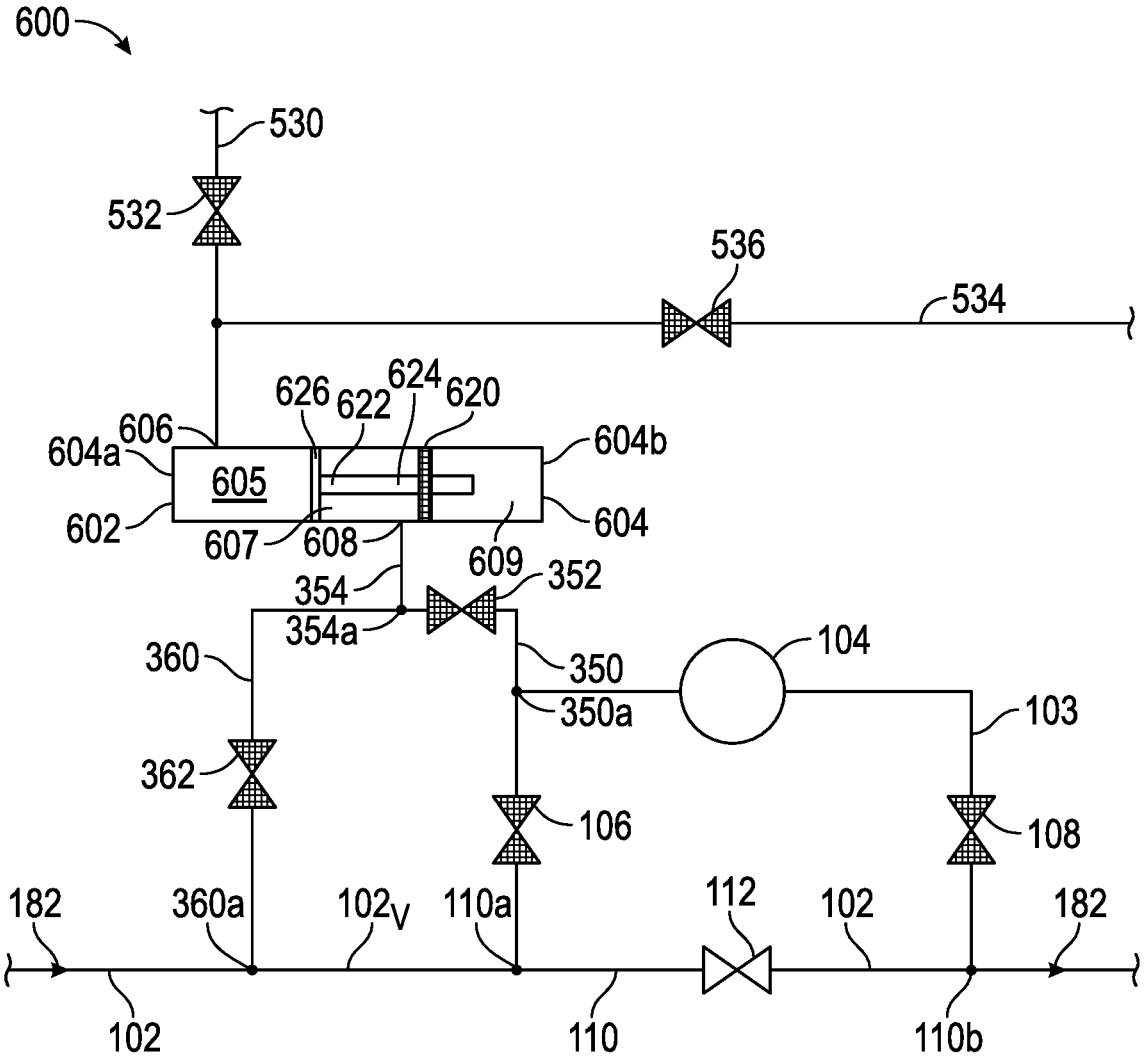
FIG. 11 is a schematic block diagram of another embodiment of a fluid system in accordance with principles disclosed herein.

Referring to FIG. 11, another embodiment of a fluid system or pumping station 600 is shown, where pumping station 600 includes many features in common with pumping stations 300 and 500 described above, with shared features labeled similarly. In this embodiment, pumping station 600 includes a fluid displacer 602 configured to remove mass or fluid from pumping station 600 in order to prevent the formation of hydrates within station 600, or to remove already formed hydrates from station 600. In this embodiment, fluid displacer 602 includes a cylinder 604, a partition 620 disposed within and affixed to cylinder 604, and a piston 622 slidably disposed within cylinder 604.

Cylinder 604 of fluid displacer 600 includes a first end 604*a*, a second end 604*b*, a first port 606, and a second port 608, where ports 606 and 608 are disposed first end 604*a* of cylinder 604 and partition 620. Piston 622 includes a piston rod 624 and a pressure flange 626 disposed at an end of rod 624 and extending radially outwards from rod 624, where an outer surface of flange 626 sealingly engages an inner surface of cylinder 604. Rod 624 extends through partition 620 allowing piston 622 to be displaced through cylinder 604. Partition 620 and flange 626 of piston 622 divides cylinder 604 into a first chamber 605 extending between first end 604*a* and flange 624, a second chamber 607 extending between flange 624 and partition 620, and a third chamber 609 extending between partition 620 and the second end 604*b* of cylinder 604. First chamber 605 is in fluid communication with first port 606 while second chamber 607 is in fluid communication with second port 608. In this embodiment, third chamber 609 is filled with a compressible gas configured to bias piston 622 towards the first end 604*a* of cylinder 604. First chamber 605 is in fluid communication with inhibitor pressurization line 530 via first port 606, and cylinder flowline 354 is in fluid communication with second chamber 607 of cylinder 604 via second port 608.

In this configuration, pumping station 600 and fluid displacer 602 are configured to displace fluid between a volume of pumping flowline 103 and volume $\mathbf{102}_V$ production flowline 102 while maintaining isolation of pumping flowline 103 from production flowline 102. Particularly, to displace fluid from pumping flowline 103 valves 536 and 352 may be opened (while valves 532 and 362 are maintained in the closed position), allowing fluid from pumping flowline 103 to be displaced into second chamber 607 of cylinder 604 and for fluid disposed in first chamber 605 to be dumped from cylinder 604 via flowline 534. The displacement of fluid from pumping flowline 103 into second chamber 607 displaces piston 622 towards first end 604*a* of cylinder 604 (assisted by a pressure force against piston 622 from gas disposed in third chamber 609), increasing the volume of second chamber 607 and decreasing the volume of first chamber 605. Subsequently, valves 352 and 536 are closed while valves 362 and 532 are opened, thereby displacing pressurized fluid into first chamber 605 via flowline 530, forcing piston 622 to be displaced towards second end 604*b* of cylinder 604. The displacement of piston 622 forces fluid disposed in second chamber 607 to flow into production flowline 102 via flowline 360.

Conversely, fluid may be displaced from production flowline 102 to pumping flowline 103 by opening valves 362 and 536 while valves 532 and 352 are closed, allowing fluid to flow into second chamber 607 of cylinder 604 via flowline 360 and for fluid disposed in first chamber 605 to be dumped via flowline 534 in response to displacement of piston 622 towards first end 604*a* of cylinder 604 (assisted by a pressure force against piston 622 from gas disposed in third chamber 609). Subsequently, valves 362 and 536 are closed while valves 532 and 352 are opened, supplying pressurized fluid to first chamber 605 via flowline 530 and displacing fluid from second chamber 607 to pumping flowline 103 via flowline 350 in response to displacement of piston 622 towards second end 604*b* of cylinder 604.

Figure 12:
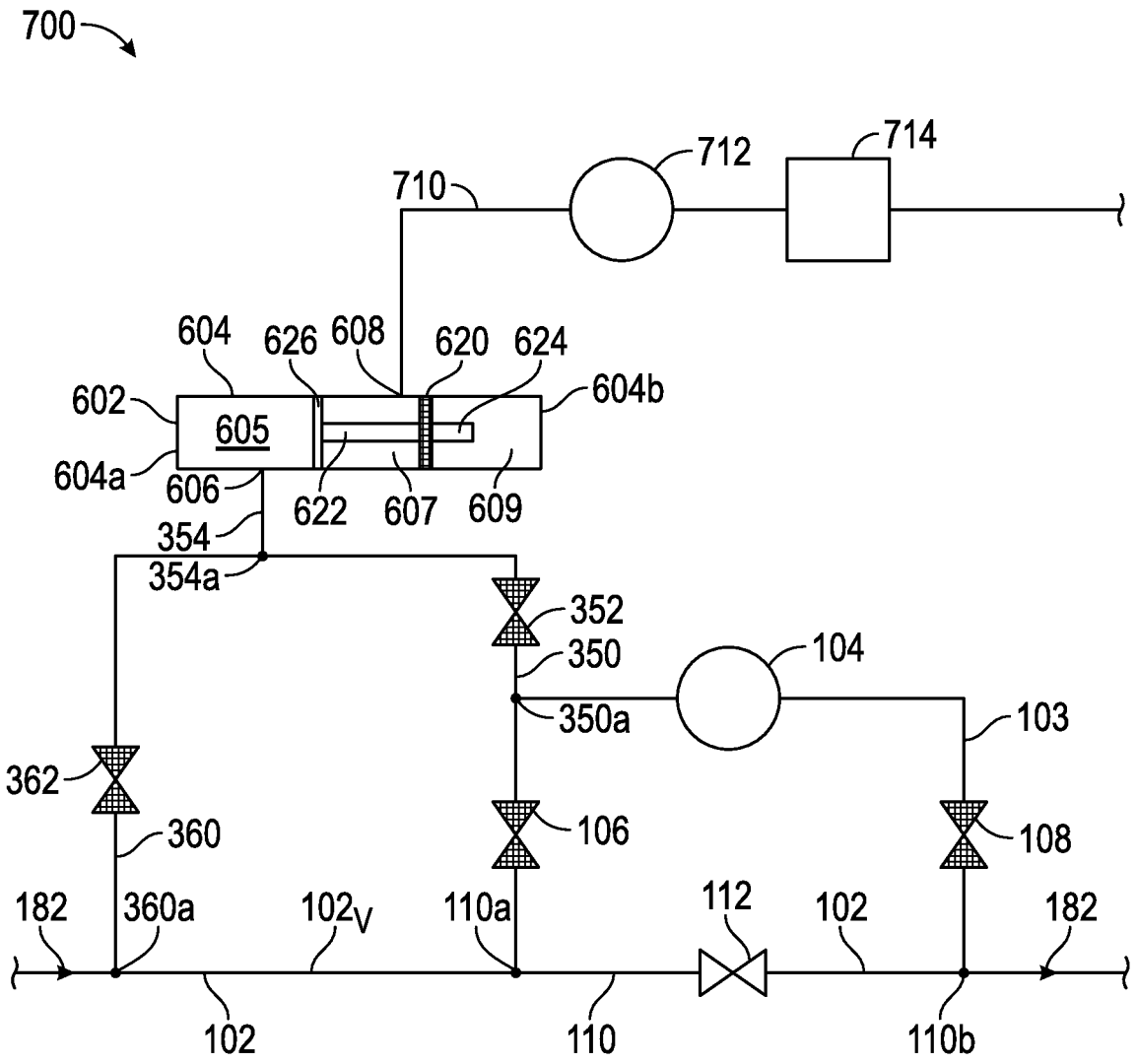
FIG. 12 is a schematic block diagram of another embodiment of a fluid system in accordance with principles disclosed herein.

Referring to FIG. 12, another embodiment of a fluid system or pumping station 700 is shown, where pumping station 600 includes many features in common with pumping stations 300 and 600 described above, with shared features labeled similarly. Particularly, in this embodiment pumping station includes fluid displacer 602 but with first port 606 connected with flowline 354 and second port 608 connected with a fluid displacement flowline 710 comprising a two-way pump 712 and a fluid accumulator or reservoir 714. Reservoir 714 provides a pressurized fluid source to flowline 710 while pump 712 is configured to pump fluid both from and into second chamber 607 of cylinder 604.

In this configuration, pumping station 700 and fluid displacer 602 are configured to displace fluid between a volume of pumping flowline 103 and volume $\mathbf{102}_V$ production flowline 102 while maintaining isolation of pumping flowline 103 from production flowline 102. Particularly, to displace fluid from pumping flowline 103 valve 352 is opened while valve 362 remains closed, providing fluid communication between first chamber 605 and pumping flowline 103 via flowline 350. Pump 712 is actuated to displace fluid from second chamber 607 to reservoir 714, thereby decreasing pressure within second chamber 607 and allowing fluid disposed in pumping flowline 103 to flow into first chamber 605 of cylinder 604 as piston 622 is displaced towards second end 604*b*. Subsequently, valve 352 is closed and valve 362 is opened to provide for fluid communication between first chamber 605 of cylinder 604 and production flowline 102 via flowline 360. Pump 712 is actuated to pump fluid from reservoir 714 into second chamber 607 of cylinder 604, thereby displacing piston 622 towards first end 604*b* and displacing fluid disposed in first chamber 605 into production flowline 102.

Conversely, fluid may be displaced from production flowline 102 into pumping flowline 103 by first opening valve 362 and closing valve 352. Pump 712 is then actuated to pump fluid from second chamber 607 of cylinder 604 into reservoir 714, allowing fluid disposed in production flowline 102 to flow into first chamber 605 as piston 622 is displaced towards second end 604*b* of cylinder 604. Subsequently, valve 362 is closed and valve 352 is opened to provide fluid communication between first chamber 605 and pumping flowline 103. Pump 712 is actuated to pump fluid from reservoir 714 into second chamber 607 to displace piston 622 towards first end 604*a* and displace fluid from first chamber 605 of cylinder 604 into pumping flowline 103.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A fluid system, comprising:

a pumping flowline, wherein the pumping flowline is in selectable fluid communication with a production flowline;

a cylinder comprising a first port and a second port;

a piston slidably disposed in the cylinder, the piston sealing against an inner surface of the cylinder to form a first chamber and a second chamber, wherein the first chamber is in fluid communication with the first port and the second chamber is in fluid communication with the second port;

a first flowline fluidically connected between the first port of the cylinder and the pumping flowline, the first flowline comprising a first flowline valve; and a second flowline fluidically connected between the first chamber of the cylinder and the production flowline, wherein the second flowline provides a fluid flowpath extending from the first chamber through the second flowline and into the production flowline while bypassing the pumping flowline;

wherein, in response to opening the first flowline valve, the piston is displaced through the cylinder in a first direction to expand a volume of the first chamber of the cylinder.

2. The fluid system of claim 1, wherein the pumping flowline comprises a compressor or a pump.

3. The fluid system of claim 1, further comprising a bypass flowline configured to direct production fluid flow away from the pumping flowline when the pumping flowline is isolated from the production flowline.

4. The fluid system of claim 1, wherein, in response to the expansion of the volume of the first chamber, a fluid pressure of the pumping flowline is decreased.

5. The fluid system of claim 1, wherein the second flowline is in fluid communication with the first chamber of the cylinder and the pumping flowline, the second flowline comprising a second flowline valve.

6. The fluid system of claim 5, wherein, in response to a pressurization of the second chamber of the cylinder via the second port, the piston is displaced in a second direction opposite the first direction to reduce a volume of the first chamber of the cylinder.

7. The fluid system of claim 6, wherein, in response to the reduction of the volume of the first chamber, a fluid pressure of the pumping flowline is increased.

8. The fluid system of claim 5, wherein, in response to the pressurization of the second chamber via the second port, a fluid flow is produced between the first chamber of the cylinder and the production flowline while the first chamber of the cylinder is sealed from the pumping flowline.

9. The fluid system of claim 1, wherein the first flowline has a first end connected to the pumping flowline and a second end connected to the second flowline, and wherein the second flowline has an end connected to the production flowline.

10. A method for preventing the formation of hydrates in a fluid system, comprising:

fluidically isolating a pumping flowline from a production flowline;

opening a valve of a first flowline fluidically connected between a first port of a cylinder and the pumping flowline;

displacing a piston through the cylinder in a first direction in response to opening the valve of the first flowline;

decreasing a fluid pressure of the pumping flowline in response to displacing the piston through the cylinder in the first direction; and displacing the piston in a second direction opposite the first direction to flow a fluid along a fluid flowpath that is isolated from the pumping flowline, wherein the fluid flowpath extends from the first port, through a second flowline, and into the production flowline.

11. The method of claim 10, further comprising expanding a volume of a first chamber of the cylinder extending between the first port and the piston in response to displacing the piston in the first direction.

12. The method of claim 10, further comprising:

pressurizing a second chamber of the cylinder extending between a second port of the cylinder and the piston; and displacing the piston in the second direction to reduce the volume of the first chamber in response to the pressurization of the second chamber.

13. The method of claim 12, further comprising increasing the fluid pressure of the pumping flowline in response to displacing the piston in the second direction.

14. The method of claim 10, wherein the first flowline has a first end connected to the pumping flowline and a second end connected to the second flowline, and wherein the second flowline has an end connected to the production flowline.

* * * * *